United States Patent [19]

Ohgoshi et al.

[11] 4,333,034

[45] Jun. 1, 1982

[54] GRID STRUCTURE FOR COLOR CATHODE RAY TUBE

[75] Inventors: Akio Ohgoshi; Akira Nakayama; Yoshihiro Tsukamura; Takehisa Natori, all of Tokyo, Japan

[73] Assignee: Sony Corporation, Tokyo, Japan

[21] Appl. No.: 139,642

[22] Filed: Apr. 14, 1980

[30] Foreign Application Priority Data

Apr. 18, 1979 [JP] Japan ..... 54/47486

[51] Int. Cl.[3] ..... H01J 29/06

[52] U.S. Cl. ..... 313/407; 29/449; 313/348

[58] Field of Search ..... 313/403–408, 313/417, 456, 458, 470, 402; 29/446, 449, 452

[56] References Cited

U.S. PATENT DOCUMENTS

| | | | |
|---|---|---|---|
| 2,939,981 | 6/1960 | Hoagland | 313/407 |
| 3,030,536 | 4/1962 | Hackett et al. | 313/402 X |
| 3,638,063 | 1/1972 | Tachikawa et al. | 313/348 |
| 3,855,493 | 12/1974 | Snook et al. | 313/402 |
| 3,942,064 | 3/1976 | Dimmick et al. | 313/407 |
| 4,100,451 | 7/1978 | Palac | 313/404 |

FOREIGN PATENT DOCUMENTS

| | | | |
|---|---|---|---|
| 2407295 | 8/1974 | Fed. Rep. of Germany | 313/402 |
| 46-30869 | of 1971 | Japan | 313/407 |

*Primary Examiner*—Paul L. Gensler

*Attorney, Agent, or Firm*—Lewis H. Eslinger; Alvin Sinderbrand

[57] ABSTRACT

A grid structure for a color cathode ray tube comprises a substantially rectangular, one-piece frame consisting of a pair of first opposed frame portions and a pair of second opposed frame portions orthogonally related to the first frame portions and being integral with the latter at ends thereof, and grid elements secured to the first frame portions and extending therebetween generally parallel to the second frame portions in a longitudinally stressed condition, the second frame portions having at least recesses therein for enhancing the resilient bending thereof under loads applied to the first frame portions in directions urging the latter toward each other.

11 Claims, 7 Drawing Figures

GRID STRUCTURE FOR COLOR CATHODE RAY TUBE

BACKGROUND OF THE INVENTION

1. Field of the Invention

This invention relates generally to a grid structure, and is more particularly directed to an improved grid structure usable in a color cathode ray tube for determining the landing positions of one or more electron beams on a phosphor screen of the color cathode ray tube.

2. Description of the Prior Art

In existing color cathode ray tubes, such as, tubes of the type identified commercially by the trademark Trinitron, a grid structure, frequently called an aperture grill, is provided within the tube envelope in facing relation to the phosphor screen formed on the inner surface of the tube's face plate. Such grid structure is provided to ensure that electron beams emitted from a gun located in the neck portion of the tube envelope will be made to land on corresponding color phosphor stripes on the screen as the latter is scanned.

In accordance with the prior art, the grid structure includes a frame comprised of a pair of opposing support bars which extend laterally adjacent the top and bottom of the screen, and brace members disposed at opposite sides of the frame and connecting the support bars. The grid structure further comprises a large number of fine, wire-like grid elements extending parallel to each other in the vertical direction and being stretched between the support bars to which the grid elements are welded or otherwise secured. The grid elements are heated and expanded longitudinally during operation of the color cathode ray tube by reason of the impingement of the grid elements of the electron beam or beams scanning the phosphor screen. Therefore, in the inoperative or cool condition of the grid structure, the grid elements need to be longitudinally tensioned or stressed between the support bars by amounts sufficient to ensure that the grid elements will remain taut, and thus accurately positioned relative to each other, even when heated and expanded. In order to provide the desired longitudinal stressing or tensioning of the grid elements, the latter are welded or secured to the support bars at a time when the latter are displaced toward each other by loads applied thereto sufficient to effect resilient flexing of the brace members. After welding of the grid elements to the support bars, the loads urging the support bars toward each other are withdrawn so that the brace members tend to resiliently return to their original positions and cause the desired longitudinal stressing of the grid elements between the support bars.

In the above-described existing grid structure, the frame is made of a suitable steel, such as, carbon steel or the like, so as to be capable of withstanding the loads applied thereto during the welding of the grid elements to the frame, and also the loading of the frame resulting from the longitudinal stressing of the grid elements when the frame is completed. In order to provide the requisite strength and also sufficient resilient flexing of the frame under the influence of the loads applied thereto while securing the grid elements thereto, the support bars are conveniently provided with L-shaped cross-sections, while the brace members are given C-shaped configurations and formed of bar stock of rectangular cross-section. Such grid structure, in which the support bars and C-shaped brace members are formed separately and when welded together to form an integral structure and in which the tensioning of the grid elements results mainly from the resiliency of the C-shaped brace members, is relatively complicated in structure, expensive and heavy, and present difficulties in maintaining the desired manufacturing tolerances and accuracy.

When it has been attempted to avoid the above problems in the case of the grid structures of small cathode ray tubes by employing a grid structure frame of one-piece construction which is pressed or stamped to have a generally rectangular ring-like configuration, either the strength of the frame is insufficient to withstand the loading resulting from the tensioned grid elements or, if the cross-sectional shape and thickness of the pressed or stamped frame have been selected to provide the frame with a strength sufficient for that purpose, the resulting frame does not have adequate resiliency for imparting the necessary longitudinal stresses or tension to the grid elements, particularly to the grid elements located adjacent the opposite side portions of the grid structure.

OBJECTS AND SUMMARY OF THE INVENTION

Accordingly, an object of the present invention is to provide a novel grid structure for use in a color cathode ray tube and which avoids the above-mentioned defects inherent in the prior art.

Another object of the invention is to provide a grid structure, as aforesaid, in which its entire frame is formed as an integral or one-piece member so as to be relatively easily manufactured, inexpensive and light in weight.

Still another object of the invention is to provide a grid structure with an easily manufactured frame of sufficient strength and resiliency as to be operable to provide grid elements secured thereto with accurately predetermined longitudinal stressing in a stable manner for a long period of time.

A further object of the invention is to provide a grid structure, as aforesaid, which, when employed in a color cathode ray tube, ensures that electron beams corresponding to respective colors and entering the spaces between adjacent grid elements with different angles, can be positively made to impinge or land on respective color phosphors of the phosphor screen.

In accordance with an aspect of this invention, a grid structure for a color cathode ray tube comprises a substantially rectangular, one-piece frame consisting of a pair of first opposed frame portions and a pair of second opposed frame portions orthogonally related to the first frame portions and being integral with the latter at ends thereof, and grid elements secured to the first frame portions and extending therebetween generally parallel to the second frame portions in a longitudinally stressed condition, with the second frame portions having means for enhancing the resilient bending thereof under loads applied to the first frame portions in directions urging the latter toward each other. It is a feature of this invention that the aforesaid means for enhancing the resilient bending of the second frame portions is constituted by at least one or more recesses in each of the latter.

The above, and other objects, features and advantages of the invention, will be aparent from the following detailed description of illustrative embodiments to be read in conjunction with the accompanying drawings in which like parts of the various embodiments are identified by the same reference numerals.

DESCRIPTION OF THE PREFERRED EMBODIMENTS

Figure 1:
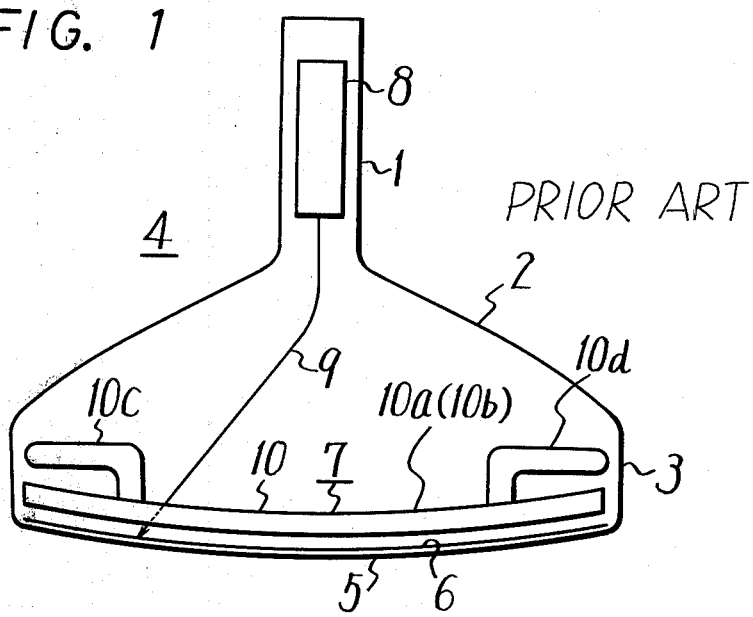
FIG. 1 is a schematic top plan view of a color cathode ray tube provided with a grid structure according to the prior art.

Before proceeding with the detailed description of preferred embodiments of this invention, reference will be made to FIG. 1 in which it is shown that, in a presently known color cathode ray tube of the type identified commercially by the trademark Trinitron, the tube envelope 4 is constituted by a neck portion 1 from which a funnel-shaped portion 2 extends to be bonded, at its outer edge, to flange portion 3 provided along the periphery of a face plate 5. The face plate 5 has a phosphor screen 6 formed on its inner surface, and a grid structure 7, also referred to as an aperture grill, is located within tube envelope 4 adjacent face plate 5 in facing relation to phosphor screen 6. An electron gun 8 is located in neck portion 1 of the tube envelope and emits three beams respectively corresponding to red, green and blue colors, but only one of which is indicated at 9 on FIG. 1. The electron beams corresponding to red, green and blue colors are made to land on respective color phosphor stripes of screen 6 by means of grid structure 7.

Figure 2:
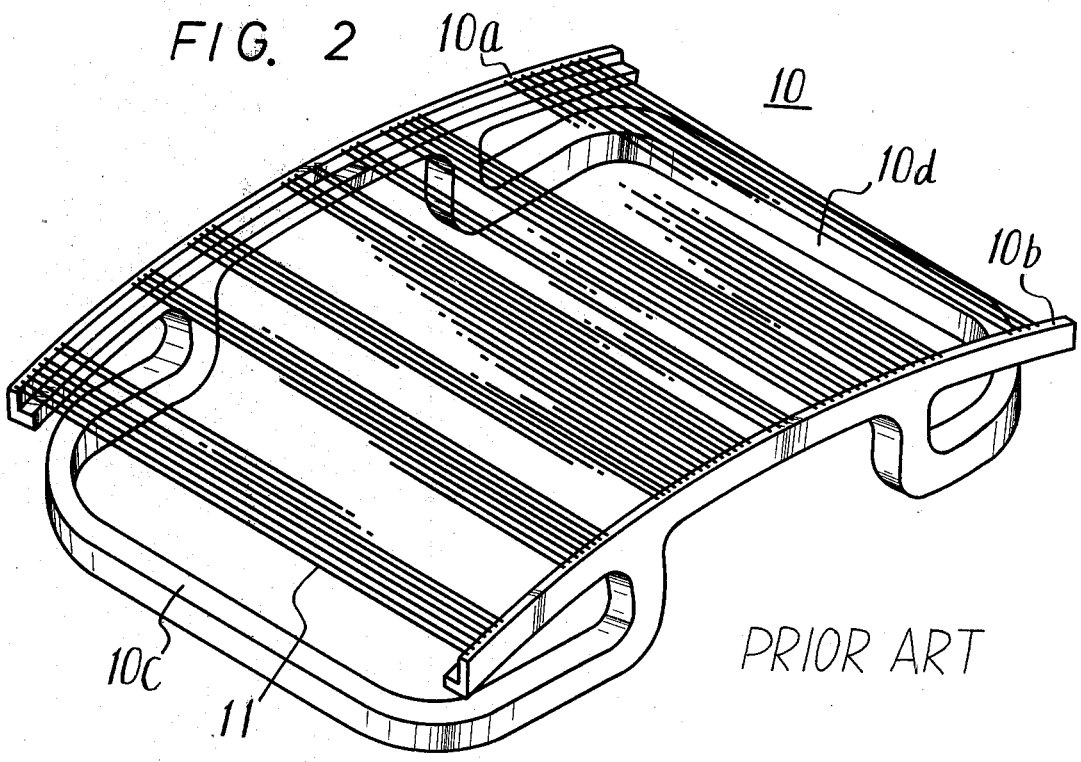
FIG. 2 is a perspective view of the grid structure according to the prior art employed in the color cathode ray tube of FIG. 1.

The grid structure 7 according to the prior art is shown on FIGS. 1 and 2 to generally comprise a frame 10 and a large number of spaced apart fine grid elements 11 extending parallel to each other across frame 10. More particularly, frame 10 is shown to consist of a pair of opposing support bars 10*a* and 10*b* extending laterally across the frame at the top and bottom thereof, and C-shaped brace members 10*c* and 10*d* arranged at the opposite sides of frame 10 and connecting support bars 10*a* and 10*b*, as particularly shown on FIG. 2. Support bars 10*a* and 10*b* are desirably provided with L-shaped cross-sections, as shown, and grid elements 11 are stretched, in parallel, spaced apart relation to each other between the forwardly facing edge surfaces of support bars 10*a* and 10*b* to which the grid elements are welded. The grid elements 11 are desirably formed by selectively etching a metal sheet or plate so as to provide such sheet with a large number of parallel slits which are suitably spaced apart for defining the fine grid elements 11 therebetween. In such case, the ends of adjacent grid elements 11 are integrally connected together by continuous edge portions of the etched metal sheet at which the grid elements may be conveniently welded to support bars 10*a* and 10*b*.

In order to ensure that grid elements 11 will remain taut between support bars 10*a* and 10*b* and thus remain accurately and securely positioned relative to the phosphor stripes of screen 6 even when the grid elements are heated, and thus longitudinally expanded, as a result of impingement of the electron beam or beams 9 on grid elements 11 when scanning screen 6 during operation of the cathode ray tube, it is necessary that grid elements 11 be longitudinally stressed or tensioned, in the cold state of the grid structure, with a suitable distribution of the longitudinal stressing of the grid elements 11 across the width of the grid structure. For the purpose of providing the necessary longitudinal stressing of grid elements 11, support bars 10*a* and 10*b* are displaced toward each other by loads applied thereto sufficient to effect resilient flexing of C-shaped brace members 10*c* and 10*d* at the time when the continuous edge portions of the etched metal sheet defining grid elements 11 are being welded to support bars 10*a* and 10*b*. After such welding has been completed, the loads urging support bars 10*a* and 10*b* toward each other are withdrawn so that brace members 10*c* and 10*d* can resiliently seek to return to their original positions and thereby cause the desired longitudinal stressing of grid elements 11 between support bars 10*a* and 10*b*. It will be noted that, for the purpose of providing a desirable distribution of the longitudinal stressing of grid elements 11 across the entire grid structure, support bars 10*a* and 10*b* need to be made relatively rigid, for example, by providing them with the illustrated L-shaped cross-section, while brace members 10*c* and 10*d* need to be resiliently flexible and preferably connected to support bars 10*a* and 10*b* at so-called Bessel points along the latter. The fact that such Bessel points are spaced inwardly from the ends of support bars 10*a* and 10*b*, and that brace members 10*c* and 10*c* must not interfere with the scanning of screen 6 by the electron beam or beams 9, accounts for the selection of the C-shaped configuration of brace members 10*c* and 10*d* which also contributes to the resilient flexibility thereof. However, the described configurations of support bars 10*a* and 10*b* and of brace members 10*c* and 10*d*, for the purposes indicated, make it necessary for such portions of the grid structure frame to be separately fabricated and then welded together to form the frame. By reason of the foregoing, the known frame of FIG. 2 is a relatively complicated structure which is expensive to produce and relatively heavy, and which presents difficulties in maintaining the necessary dimensional tolerances during manufacture.

Figure 3:
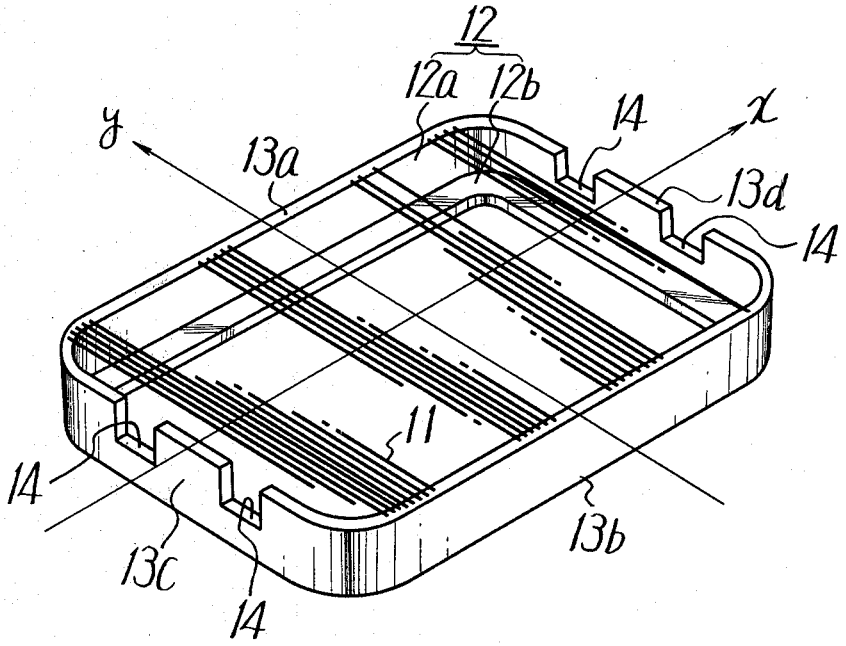
FIG. 3 is a perspective view of a grid structure according to an embodiment of the present invention, and which may be used in the color cathode ray tube of FIG. 1 in place of the grid structure of FIG. 2.

Referring now to FIG. 3, it will be seen that a grid structure according to an embodiment of this invention again generally comprises a large number of parallel, spaced grid elements 11 and a frame 12. However, in accordance with this invention, the frame 12 is an integral or one-piece member which is simply punched or pressed from a metal plate, for example, of a stainless steel containing from 13 to 18 percent of chromium so as to be of superior thermal resistance and resiliency. The frame 12 is substantially in the form of a rectangular ring of generally L-shaped cross-section so that frame 12 includes a web or side wall 12*a* and a flange 12*b* directed inwardly toward the center of the frame from a margin of web 12*a*. The rectangular frame 12 is shown to consist of a pair of first opposed frame portions 13*a* and 13*b* which define the long sides of the rectangular frame, and a pair of second opposed frame portions 13*c* and 13*d* orthogonally related to the first frame portions 13*a* and 13*b* and being integral with the latter at ends thereof so as to define the relatively short sides of the rectangular frame.

As shown, grid elements 11 are secured adjacent their ends, as by welding, to first frame portions 13*a* and 13*b* at the edge surface of web 12*a* which is remote from flange 12*b*. The grid elements 11 extend between first frame portions 13*a* and 13*b* generally parallel to the second frame portions 13*c* and 13*d*, and are longitudinally stressed or tensioned so as to remain taut and accurately positioned even when grid elements 11 are longitudinally expanded in response to the heating thereof during operation of the color cathode ray tube. Such longitudinal stressing of grid elements 11 of the grid structure according to the embodiment of this invention shown on FIG. 3 is effected generally in the same manner as previously described with reference to the known grid structure of FIG. 2. More particularly and as illustrated on FIG. 5, during the attachment of grid elements 11 to the edge surface of web 12*a* of frame 12, frame portions 13*a* and 13*b* are displaced towards each other, for example, to the positions shown in broken lines, under the influence of forces or loads applied thereto, as represented by the arrows a and b. After the completion of the welding of grid elements 11 to the edge surface of web 12*a*, the removal of the loads or forces a and b will permit frame portions 13*a* and 13*b* to seek to return to their original positions indicated in full lines on FIG. 5, whereby to longitudinally stress or tension grid elements 11 extending therebetween.

Figure 5:
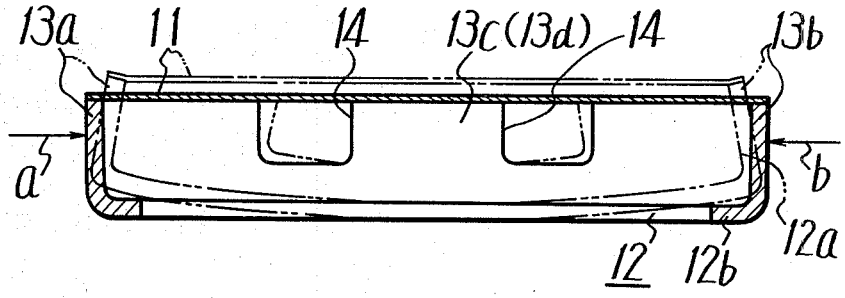
FIG. 5 is a sectional view of the grid structure of FIG. 3, with the frame thereof being shown in broken lines in a bent condition, as when the grid elements are being secured to the frame.
Figure 6:
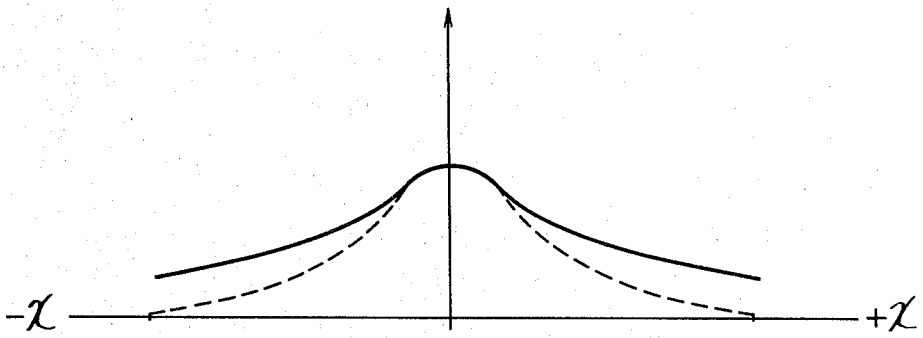
FIG. 6 is a graph showing the extent to which the frame portions to which the grid elements are secured are bent or flexed at various locations across the width of the frame.

It will be appreciated that the extent to which those grid elements 11 disposed adjacent the opposite sides of the grid structure, that is, the grid elements near to frame portions 13*c* and 13*d*, are longitudinally stressed or tensioned in response to the removal of the forces or loads a and b from frame portions 13*a* and 13*b* following the welding of the grid elements to frame 12 will be determined by the extent to which frame portions 13*c* and 13*d* were resiliently bent or flexed, for example, as indicated in broken lines on FIG. 5, in response to the application of the loads or forces a and b to frame portions 13*a* and 13*b*. In other words, if the frame is provided with a cross-section which is not varied along the entire perimeter of the frame, then the application of the loads a and b to web 12*a* to about the midpoints of the long frame portions 13*a* and 13*b* will, for the most part, cause torsional deflection or twisting of frame portions 13*a* and 13*b* while frame portions 13*c* and 13*d* will bend only slightly, if at all, from the normal or original position indicated in full lines on FIG. 5. Therefore, when grid elements 11 are welded to frame portions 13*a* and 13*b* and, thereafter, the loads or forces a and b on FIG. 5 are removed from frame portions 13*a* and 13*b*, the distribution of the longitudinal stressing of grid elements 11 in the direction of the axis x on FIG. 3 will be as indicated by the dotted line on FIG. 6. In other words, the longitudinal stressing of grid elements 11 will be at a maximum near the middle of frame 12, considered in the lateral direction of the frame, and will decline to insignificant or negligible longitudinal stressing of those grid elements disposed adjacent the opposite sides of frame 12, that is, near to frame portions 13*c* and 13*d*. By reason of the foregoing, such neglibibly tensioned grid elements located adjacent the opposite sides of the frame will become slack due to heating and expansion thereof during operation of the respective color cathode ray tube with the result that the positions of the slack grid elements can vary relative to the phosphor screen and color misregistration will result.

In order to avoid the foregoing problems, the illustrated frame 12 of a grid structure according to this invention is provided with means for enhancing the resilient bending of frame portions 13*c* and 13*d* under the loads a and b applied to frame portions 13*a* and 13*b* in directions urging the latter toward each other.

In the embodiment of the invention illustrated on FIG. 3, such means for enhancing the resilient bending of frame portions 13*c* and 13*d* are shown to comprise recesses 14 formed in web 12*a* of the frame portions 13*c* and 13*d*, and being symmetrically disposed with respect to both the x and y axes which pass through the center of frame 12 and which are parallel to frame portions 13*a* and 13*b* and frame portions 13*c* and 13*d*, respectively. In the embodiment of FIG. 3, two recesses 14 are formed in each of frame portions 13*c* and 13*d*, whereas, in the embodiment of FIG. 4, only one recess 14 is formed in each of frame portions 13*c* and 13*d*. Of course, it will be appreciated that, if desired, each of the relatively short frame portions 13*c* and 13*d* may be provided with three or more recesses provided that, in all cases, the recesses are symmetrical in respect to both the x and y axes. Further, in all instances, the recesses 14 are formed in web 12*a* so as to open at the edge surface of such web which is remote from flange 12*b*.

It will be appreciated that, by reason of recesses 14 in frame portions 13*c* and 13*d*, such frame portions are conditioned to bend resiliently or flex, for example, to the positions shown in broken lines on FIG. 5, in response to the application of the loads of forces a and b to frame portions 13*a* and 13*b*. By reason of such bending of frame portions 13*c* and 13*d*, frame portions 13*a* and 13*b* are displaced toward each other at the ends thereof joined to frame portions 13*c* and 13*d* as well as at the middle portions of frame portions 13*a* and 13*b*, when the edge portions of the previously described etched metal plate defining grid elements 11 are welded to the edge surfaces of the displaced frame portions 13*a* and 13*b*. Thereafter, upon the removal of loads or forces a and b from frame portions 13*a* and 13*b*, the resilient return of frame portions 13*c* and 13*d* toward their original positions thereof indicated in full lines on FIG. 5 causes the longitudinal stressing or tensioning of all of the grid elements. In other words, even the grid elements located adjacent the opposite sides of frame 12, that is, near frame portions 13*c* and 13*d*, will be subjected to substantial longitudinal stressing, as indicated by the curve in full lines on FIG. 6.

It will be apparent from the above that, in accordance with the present invention, the frame 12 consisting of the integrally joined frame portions 13*a*, 13*b*, 13*c* and 13*d* can be simply punched or pressed from a metal plate or sheet so as to be susceptible to mass production with high accuracy. Further, even though frame 12 is formed with the flange 12*b* to provide the strength necessary for reliably withstanding the loading of frame 12 by the longitudinal stresses or tension in grid elements 11, the provision of recesses 14 in short frame portions 13*c* and 13*d* ensures that such frame portions will be adequately resiliently bent or fixed at the time of welding of grid elements 11 to frame 12 for ensuring the eventual generation of an adequate longitudinal stressing of all of the grid elements. In other words, recesses 14 ensure that frame portions 13*c* and 13*d*, in addition to frame portions 13*a* and 13*b*, will be subject to strain or flexing in response to the application of the loads a and b to frame portions 13*a* and 13*b*.

It will be noted that the uniformity of the longitudinal stressing of grid elements 11 across the width of frame 12 is improved to the extent that the resistance to bending or flexing of frame portions 13*a* and 13*b* by loads a and b is increased, and further to the extent that the flexing of frame 12 in response to such loads is concentrated in the relatively short frame portions 13*c* and 13*d*. Thus, in accordance with another embodiment of this invention illustrated on FIG. 7, a stiffening rib 15 is pressed or punched in web 12*a* along each of frame portions 13*a* and 13*b* so as to increase the strength and resistance to bending of such frame portions. Further, each of frame portions 13*c* and 13*d* has at least one slit 16 extending longitudinally therein at the confluence of web 12*a* and flange 12*b* so as to increase the flexing of frame portions 13*c* and 13*d* in response to the loads a and b shown on FIG. 5. Each of frame portions 13*c* and 13*d* may have a single slit 16 therein at its central portion, as shown, or each of such frame portions 13*c* and 13*d* may be provided with two slits 16 (not shown) which are symmetrically disposed in respect to the central axis x.

Figure 4:
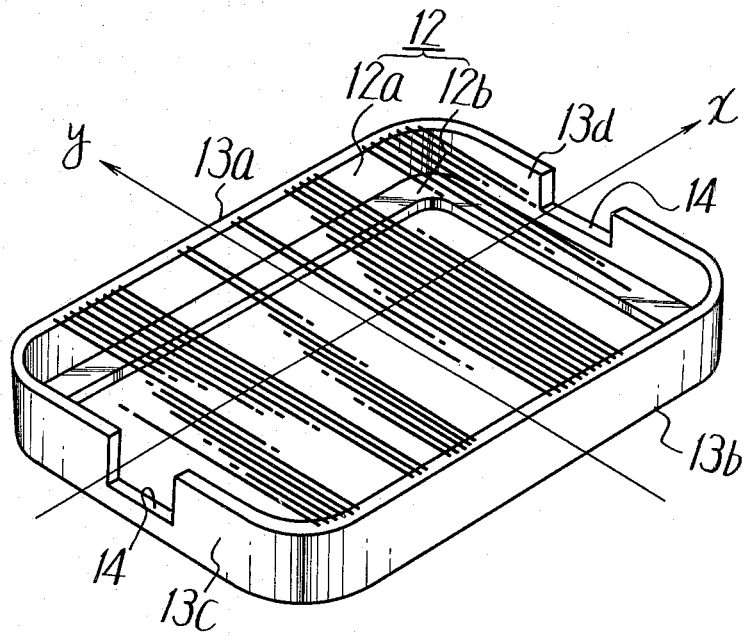
FIG. 4 is a perspective view similar to that of FIG. 3, but showing another embodiment of the present invention.
Figure 7:
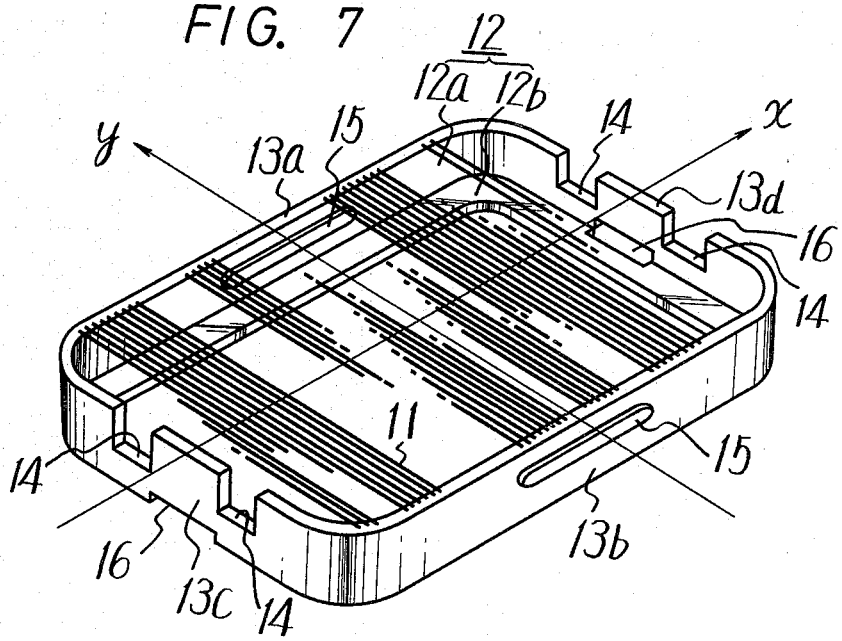
FIG. 7 is a perspective view similar to that of FIGS. 3 and 4, but showing still another embodiment of the invention.

It will be understood that, in the embodiments of the invention illustrated by FIGS. 3, 4 and 7, the grid elements 11 may have their ends individually welded or otherwise fixed to frame portions 13*a* and 13*b*, or such ends of the grid elements may be joined together by continuous edge portions of an etched metal sheet defining the grid elements with such edge portions of the etched metal sheet then being welded to frame portions 13*a* and 13*b*, as has been previously described.

Although illustrative embodiments of the invention have been described in detail herein with reference to the accompanying drawings, it is to be appreciated that the invention is not limited to those precise embodiments, and that various changes and modifications may be effected therein by one skilled in the art without departing from the scope or spirit of the invention as defined in the appended claims.

What is claimed is:

1. A grid structure for a color cathode ray tube comprising a substantially rectangular frame consisting of a pair of first opposed frame portions and a pair of second opposed frame portions orthogonally related to said first frame portions and being integral with the latter at ends thereof, and grid elements secured to said first frame portions and extending therebetween generally parallel to said second frame portions in a longitudinally stressed condition, said second frame portions having recesses therein for enhancing the resilient bending thereof under loads applied to said first frame portions in directions urging the latter toward each other.

2. A grid structure according to claim 1; in which there is one of said recesses in each of said second frame portions, and each of said recesses is symmetrical in respect to a line passing through the center of said frame perpendicular to said second frame portions.

3. A grid structure according to claim 1; in which there are a plurality of said recesses in each of said second frame portions, and said recesses in each of said second frame portions are symmetrically disposed in respect to a line passing through the center of the frame perpendicular to said second frame portions.

4. A grid structure according to claim 1; in which each of said frame portions is of generally L-shaped cross-section so that said frame includes a web having an edge surface at which said grid elements are secured to said first frame portions and a flange directed inwardly toward the center of the frame from said web at a margin of the latter remote from said edge surface.

5. A grid structure according to claim 4; in which said recesses for enhancing the resilient bending of said second frame portions open at said edge surface of the web.

6. A grid structure according to claim 5; in which there is one of said recesses in each of said second frame portions, and each of said recesses is symmetrical in respect to a line passing through said center of the frame perpendicular to said second frame portions.

7. A grid structure according to claim 5; in which there are a plurality of said recesses in each of said second frame portions, and said recesses in each of said second frame portions are symmetrically disposed in respect to a line passing through said center of the frame perpendicular to said second frame portions.

8. A grid structure according to claim 5; in which each of said second frame portions further has a slit therein substantially at said margin of the web from which said flange is directed.

9. A grid structure according to claim 8; further including a stiffening rib formed along each of said first frame portions at said web for resisting bending of said first frame portions by said loads.

10. A grid structure according to claim 5; further including a stiffening rib formed along each of said first frame portions at said web for resisting bending of said first frame portions by said loads.

11. A grid structure according to claim 1; in which said recesses for enhancing the resilient bending of said second frame portions open at an edge of the latter; and further including a slit extending longitudinally in each of said second frame portions, and a stiffening rib formed along each of said first frame portions for resisting bending of said first frame portions by said loads.

* * * * *